US009498094B2

(12) United States Patent
Van Diepen

(10) Patent No.: US 9,498,094 B2
(45) Date of Patent: Nov. 22, 2016

(54) CONTAINER FOR A PACK OF WET WIPES

(71) Applicant: Reckitt & Colman (Overseas) Limited, Berkshire (GB)

(72) Inventor: Jacobus Simon Petrus Van Diepen, Guangdong (CN)

(73) Assignee: RECKITT & COLMAN (OVERSEAS) LIMITED, Berkshire (GB)

( * ) Notice: Subject to any disclaimer, the term of this patent is extended or adjusted under 35 U.S.C. 154(b) by 96 days.

(21) Appl. No.: 14/379,713

(22) PCT Filed: Feb. 22, 2013

(86) PCT No.: PCT/GB2013/050447

§ 371 (c)(1),
(2) Date: Aug. 19, 2014

(87) PCT Pub. No.: WO2013/124677

PCT Pub. Date: Aug. 29, 2013

(65) Prior Publication Data

US 2015/0021225 A1 Jan. 22, 2015

(30) Foreign Application Priority Data

Feb. 23, 2012 (GB) ..... 1203158.9

(51) Int. Cl.
*A47K 10/42* (2006.01)
*B65D 43/20* (2006.01)
(Continued)

(52) U.S. Cl.
CPC ..... *A47K 10/422* (2013.01); *B65D 43/20* (2013.01); *B65D 83/0817* (2013.01); *A47K 2010/3266* (2013.01)

(58) Field of Classification Search
CPC ..... A47K 10/422
USPC ..... 318/1, 3, 139
See application file for complete search history.

(56) References Cited

U.S. PATENT DOCUMENTS 6,158,614 A * 12/2000 Haines ..... A47K 10/3818 221/33
7,256,694 B2 * 8/2007 Papari ..... B65F 1/1638 318/466

(Continued)

FOREIGN PATENT DOCUMENTS

EP 0915025 A1 5/1999
EP 1084670 A2 3/2001

(Continued)

OTHER PUBLICATIONS

Combined Search and Examination Report dated Jun. 22, 2012 for priority application No. GB1203158.9.

(Continued)

*Primary Examiner* — David S Luo
(74) *Attorney, Agent, or Firm* — Troutman Sanders LLP; Ryan A. Schneider; Chris N. Davis

(57) ABSTRACT

A container for a pack of wet wipes (W), the pack having a stack of wet wipes and an aperture in the top surface through which the wet wipes are accessible for dispensing, The container comprising a housing (1, 2) to receive the pack of wet wipes, An opening (9) is formed in the top surface of the housing in line with the aperture in the pack. A door (11) is arranged to selectively close the opening and a sensor (20) is arranged to detect the presence of the hand in the vicinity of the door, A motor (13) receives a signal from the sensor indicating movement in the vicinity of the door and opens the door upon receipt of the signal.

18 Claims, 7 Drawing Sheets

(51) Int. Cl.
*B65D 83/08* (2006.01)
*A47K 10/32* (2006.01)

(56) References Cited

U.S. PATENT DOCUMENTS

| | | | | |
|---|---|---|---|---|
| 8,174,216 | B2 * | 5/2012 | Lin | B65D 43/26 318/282 |
| 8,378,597 | B2 * | 2/2013 | Shek | B65F 1/1607 220/211 |
| 2011/0006060 | A1 | 1/2011 | Lin | |

FOREIGN PATENT DOCUMENTS

| | | | |
|---|---|---|---|
| FR | 2788037 | A3 | 7/2000 |
| JP | 2004231237 | A | 8/2004 |
| WO | 9923003 | A1 | 5/1999 |
| WO | 2008147904 | A2 | 12/2008 |

OTHER PUBLICATIONS

International Search Report mailed Aug. 9, 2013 for related priority PCT Application No. PCT/GB2013/050447.

* cited by examiner

CONTAINER FOR A PACK OF WET WIPES

CROSS-REFERENCE TO RELATED APPLICATIONS

This application is a U.S. National Stage of International Application No. PCT/GB2013/050447, filed 22 Feb. 2013, which claims the benefit of GB 1203158.9, filed 23 Feb. 2012, both herein fully incorporated by reference.

The present invention relates to a container for a pack of wet wipes.

Packs of wet wipes are now well known in numerous fields. Wipes impregnated with a liquid such as a cleaning agent or lotion are stacked in an interleave manner in a pack. The pack is generally formed of flow wrap closed by seams at either end and an elongate seam running along the bottom surface between the end seams. The pack is generally provided with an aperture in its upper surface which is overlaid by a resealable sticker. This sticker is pulled back to open the aperture to expose the wet wipes. As one wet wipe is pulled through the aperture, it pulls the next wipe in the stack into a position in which it is readily available at the aperture for subsequent dispensing. Unless the sticker is reclosed firmly, the top wet wipe will dry out and its performance will be severely impaired. Typically, towards the end of the life of a pack, the sticker will start to lose its adhesive properties such that it becomes more difficult to seal. It can also be torn off entirely making the pack essentially useless.

Also, a user will often open the pack when their hands are dirty thereby leaving germs on and around the reclosable sticker causing a contamination risk.

Wet wipe packs are not generally considered to be particularly attractive and therefore there is a reluctance among consumers to use them in situations where they will be displayed on counter tops and the like where they can be readily available for use. This contrasts with dry tissues which are available in aesthetically pleasing folded card packs and numerous covers are available to disguise the appearance of less aesthetically pleasing packs.

Containers are known for wet wipe packs which are simply injection moulded containers which have a large hinged lid to allow the pack of wipes to be inserted and a smaller reclosable lid to allow individual wipes to be removed and to provide a cover for the exposed individual wipes to prevent it from drying out.

One attempt to improve the design of such a container is disclosed in WO 99/23003 (and also in related applications EP 1 654 970, EP 0 915 025 and EP 0 913 336). These disclose the idea of a slidable lid which covers an aperture in the container. As the lid is slid to a closed position, an elastic member is charged with energy and the lid is latched. The lid is therefore easy to open as it simply needs to be lightly touched by a user to unlatch the lid whereupon the stored energy in the elastic member opens the lid. This arrangement does not, however, solve the problem of preventing the spread of germs as the lid must still be touched in order to open and close it.

A similar type of dispenser is disclosed in EP 1 989 982. In this case, it is designed to be mounted above a toilet roll holder.

Given these drawbacks, containers for packs of wet wipes have not found general acceptance.

According to the present invention, there is provided a container for a pack of wet wipes, the pack having a stack of wet wipes and an aperture in the top surface through which the wet wipes are accessible for dispensing, the container comprising:

- the housing to receive the pack of wet wipes;
- an opening in the top surface of the housing arranged, in use, to align with the aperture in the pack;
- a door arranged to selectively close the opening;
- a sensor arranged to detect the presence of a hand in the vicinity of the door; and
- a motor arranged to receive a signal from the sensor indicating movement in the vicinity of the door and to open the door upon receipt of the signal.

Such an arrangement provides, for the first time, a dispenser for wet wipes which does not require a user to touch a lid in order to gain access to the wet wipes, such that the spread of germs on the pack can be eliminated or at least substantially reduced. Further, a pack with a retractable door creates significant interest among consumers compared to the simple injection moulded, manually operated lids in the prior art. The present invention can therefore provide a product which is attractive to the user, such that they are more likely to use this in counter top type applications, thereby increasing the potential applications for wet wipes.

The pack of wet wipes may simply sit on the bottom of the housing. However, preferably, the container further comprises a mechanism for supporting the pack of wet wipes, the mechanism being urged towards the opening. This urging may take the form of an active drive system. However, preferably, the mechanism is spring-loaded so as to be biased towards the opening. With such a platform, the top surface of the pack can be held against the underside of the top of the container, thereby providing stable support to facilitate the removal of the wipes, particularly as the wipes are used up.

The door may be hinged. However, it is preferably a sliding door. In this case, in the open position, it is preferably received at least partially within the housing. This provides an enhanced appearance. The door may be a close enough fit within a container that this provides a sufficient barrier to prevent the evaporation of moisture from the wet wipes. However, preferably, the container further comprises a seal to seal the door with respect to the housing when the door is closed.

The sensor may be any type of motion sensor such as an infrared sensor. However, preferably the sensor is a no-touch capacitive sensor.

The motor may be arranged to close the door either a pre-set time after opening, or once the sensor ceases to detect the presence of an object in its vicinity. As an alternative, it may be a combination of the two, whereby it will close either on removal of the hand, or following a pre-set passage of time, whichever is the sooner.

If the door encounters an obstruction, the door will attempt to re-close, but if this does not happen after a number of attempts, the door will remain open and a visual or audio alarm will be activated.

An example of a container in accordance with the present invention will now be described with reference to the accompanying drawings, in which.

Figure 1A:
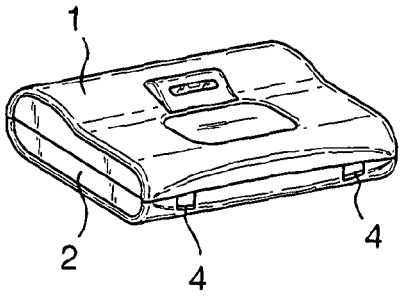
FIGS. 1A-1D are perspective views showing the container and its various stages of use.

In broad terms, the container comprises an upper shell 1 and a lower shell 2 connected together by a pair of spring-loaded hinges 3 (see FIGS. 3B and 4) along a rear edge. At the front edge are a pair of latches 4 (see FIG. 3B) which hold the two halves together. When the latches 4 are released, the springs in the spring-loaded latches 3 automatically push the two shell halves apart to open the container. The front portion of the container (accounting for approximately two thirds of the footprint of the container) is taken up by a chamber 5 in which the pack of wet wipes is received. The rear third of the container is taken up by the drive mechanism as described below.

Figure 2A:
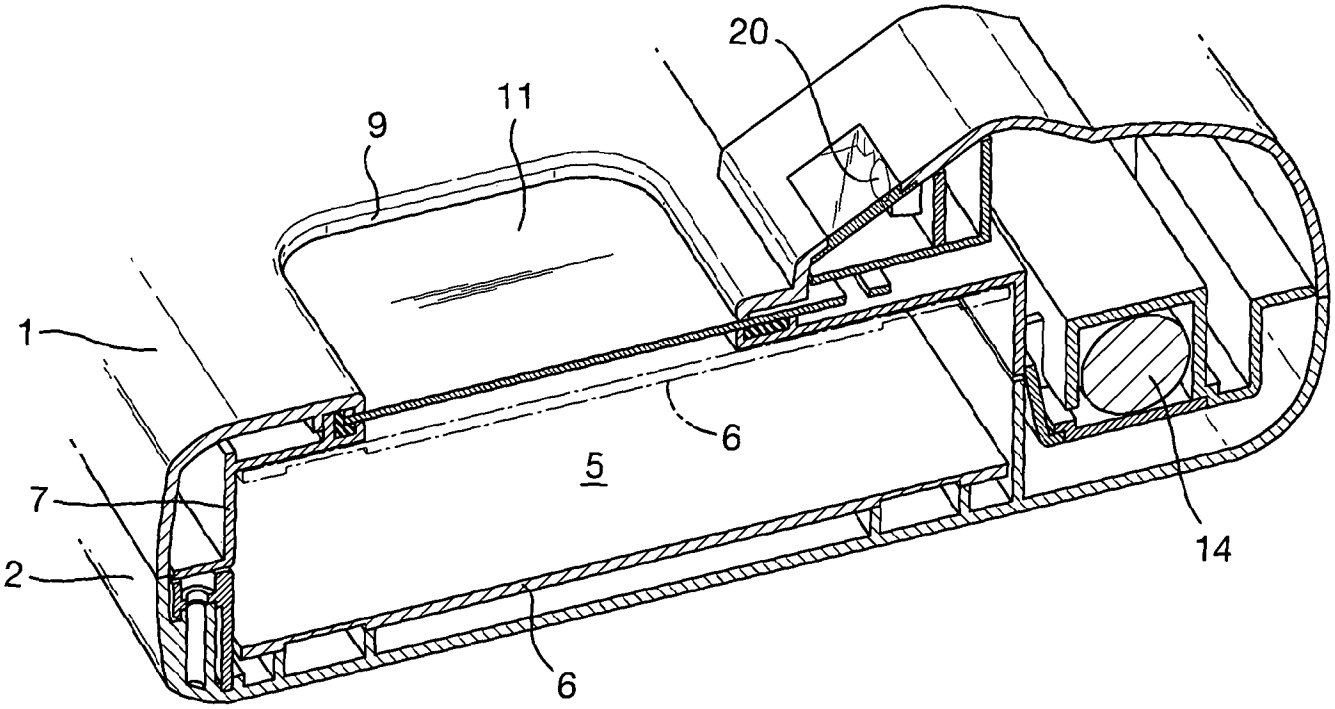
FIGS. 2A and 2B are perspective views of a cross-section through the container showing the door closed and open respectively.
Figure 2B:
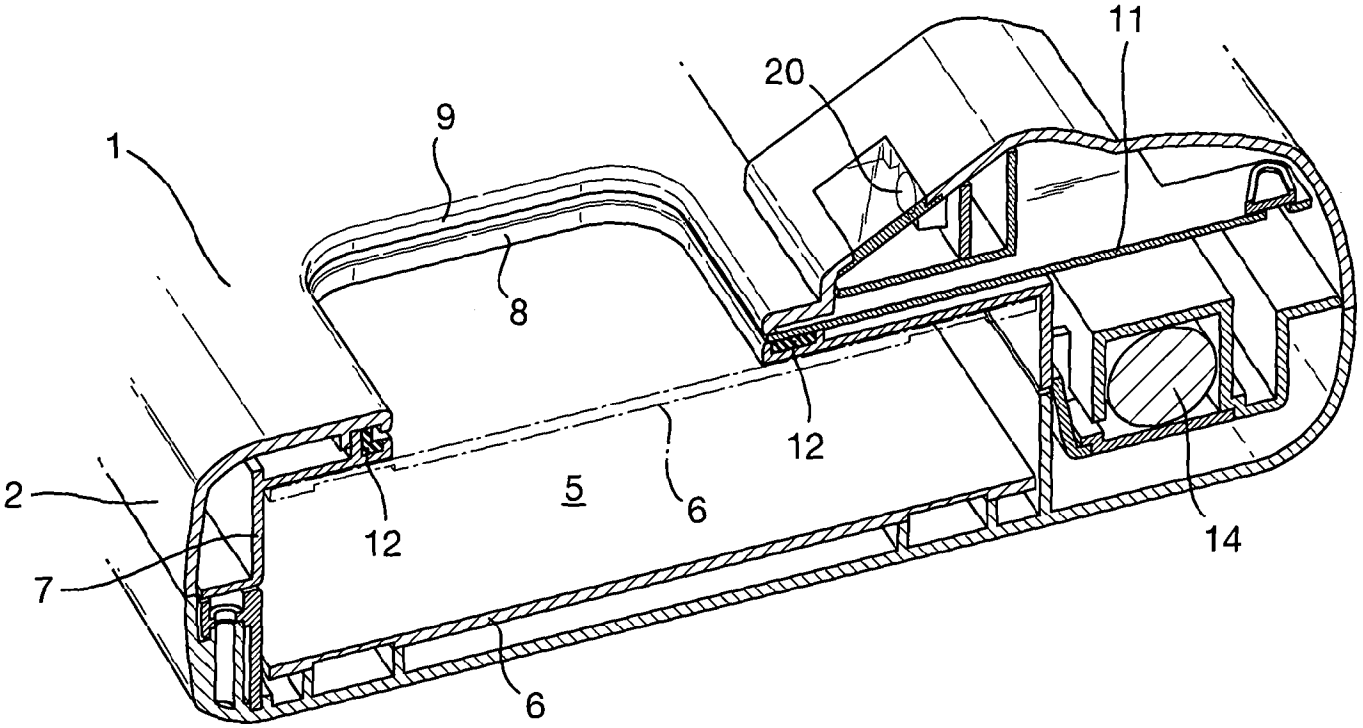
Figure 5:
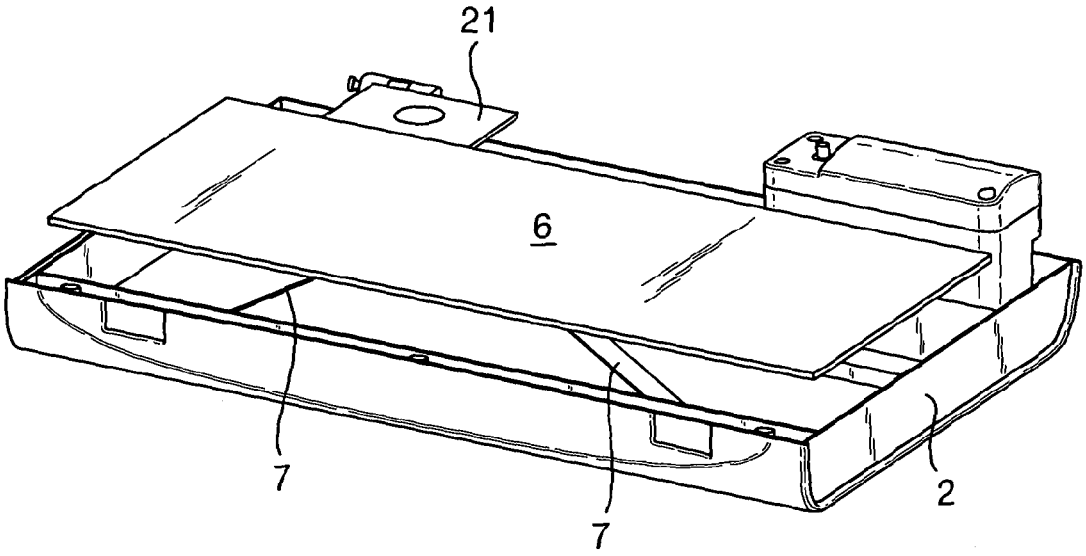
FIG. 5 is a perspective view of the lower part of the container particularly showing the spring-loaded platform.

The chamber 5 for the pack of wet wipes is defined at its lower surface by platform 6 which is shown in FIGS. 2A and 2B in both its upper and lower positions and is best shown in FIG. 5. As is apparent from FIG. 5, the platform 6 is biased upwardly by moulded plastic springs 7, two of which are visible in FIG. 5, with a further pair being provided towards the rear edge of the platform 6.

The upper part of the chamber 5 is defined by a chassis 8 which is fixed to the underside of the upper shell 1. The chassis 8 is provided with an opening 9 which also extends through the upper shell 1. The chassis 7 also defines a pair of channels 10 to serve as a guide for the sliding door 11. The sliding door 11 is shown closed in FIGS. 2A and 3A and open in FIGS. 2B and 3B. As can be seen from FIGS. 2A and 2B, a rubber seal 12 is provided in the chassis 8 to surround the opening 9 and form a seal with the door 11 when it is closed. As can be seen in FIG. 2B, the seal 12 also co-operates with the open door 11 to prevent the ingress of any dirt into the rear part of the container.

Figure 3A:
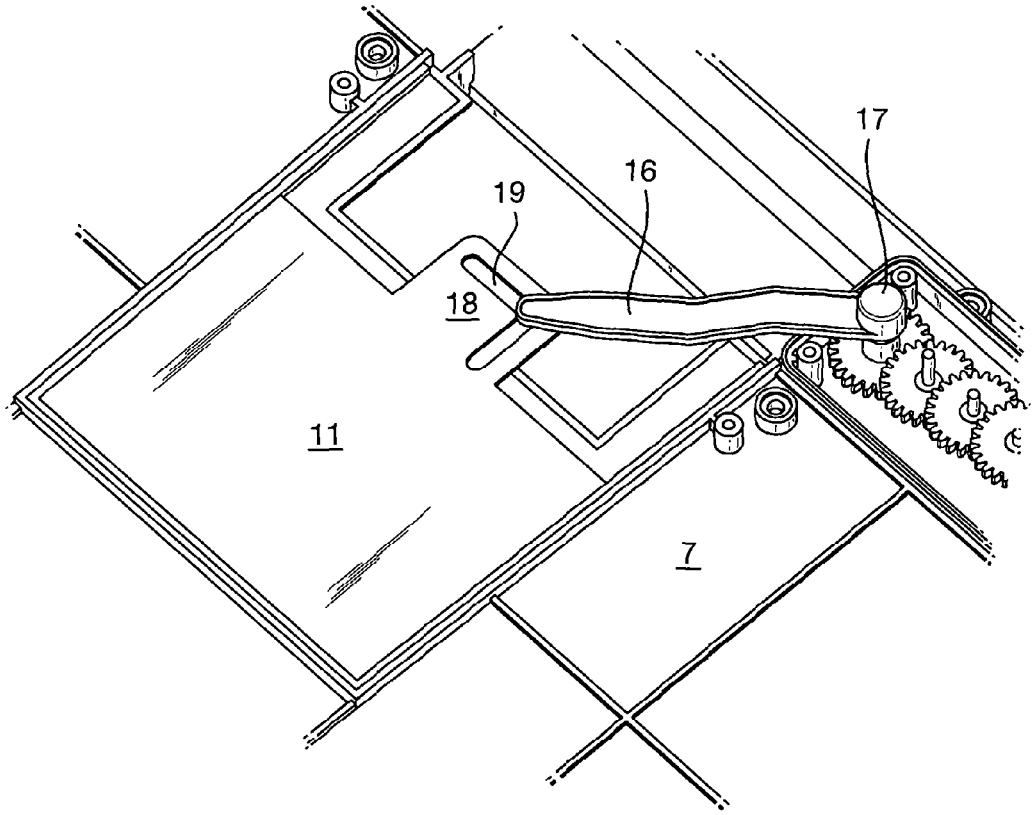
FIGS. 3A and 3B are perspective views of the top of the container with the top casing removed showing the opening mechanism, with FIG. 3A also being shown without the top of the motor casing.
Figure 3B:
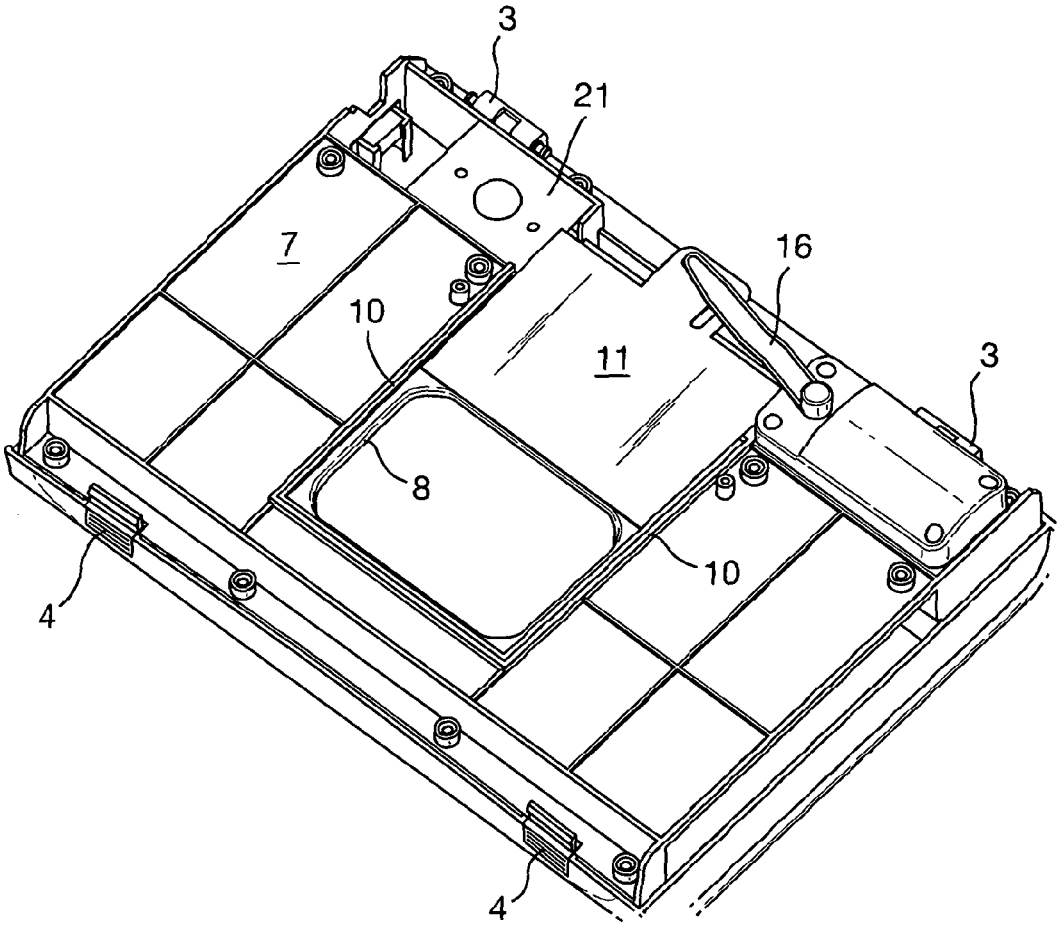
Figure 4:
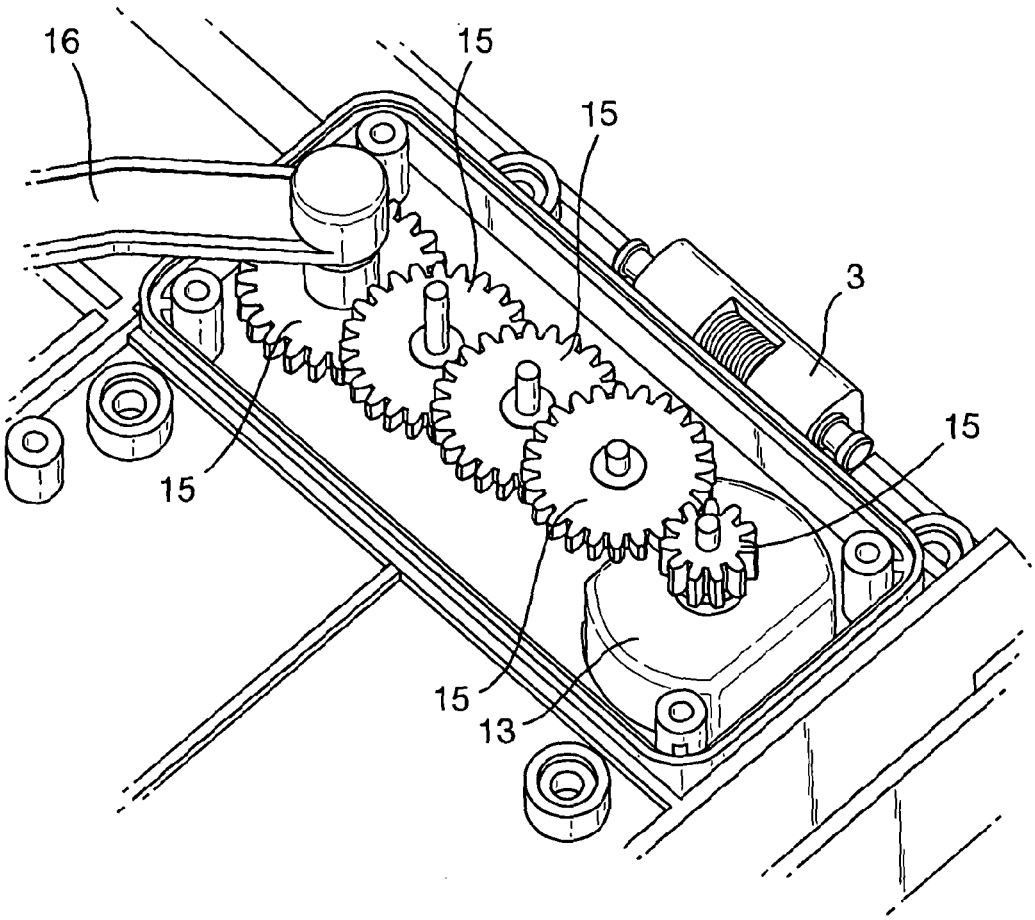
FIG. 4 is a perspective view showing the drive mechanism for the door.

The drive mechanism for the door will now be described with reference to FIGS. 3A, 3B and 4.

The door is driven by a motor 13 powered by batteries 14, but may also be mains powered. A motor 13 is connected via a set of gear wheels 15 to a pivotal arm 16. This arm 16 is mounted to pivot about a first end 17, while the opposite end 18 engages with a slot 19 in the door. Upon rotation of the motor 13 in a first direction, the pivotal arm 16 is driven by the gear wheels 15 to pivot thereby pulling the door 11 from the closed position shown in FIG. 3A to the open position shown in FIG. 3B while sliding from one end of the slot 19 to the other. To close the door, the motion is reversed.

The actuation of the motor 13 is determined by a capacitive sensor 20 under the control of control circuit 21 The sensor comprises an infrared emitter and receiver which are pointed generally at the region above the door 11. Such infrared motion sensors are well known in the art.

Figure 1B:
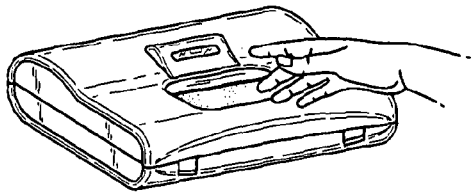
Figure 1C:
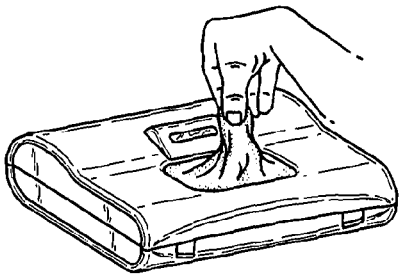
Figure 1D:
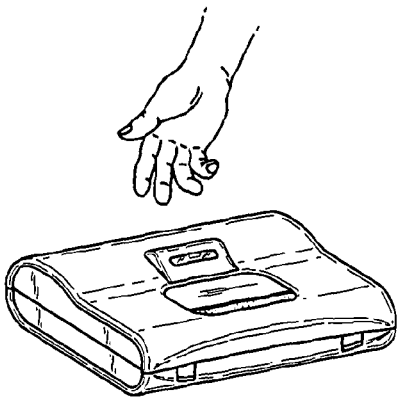

In order to fill the container with a pack of wet wipes, the user releases the catches 4 to open the two halves of the container as described. The pack is inserted with the hole on the top of the pack in alignment with the opening 9. The container is then re-closed and is switched on. It then enters a standby mode in which the sensor 20 is active. When a user wishes to take a wipe, they move their hand to the vicinity of the lid 11 (as shown in FIG. 1B), whereupon the sensor 20 detects the presence of the hand and triggers the motor 13 to open the door. The user then takes the wipe W (FIG. 1C). At this time, the sensor continues to detect the presence of the user's hand and will hold the door open. Once the hand is removed and is no longer detected by the sensor 20, the control circuit 21 will cause the motor 13 to rotate in the opposite direction to close the door 11 (FIG. 1D). As the wipes are used up, the springs 7 will tend to urge the platform 6 upwardly ensuring that the upper surface of the pack remains in close contact with the upper surface of the chamber 5.

The invention claimed is:

1. A container for a pack of wet wipes comprising:
- a housing to receive a pack of wet wipes;
- an opening in a top surface of the housing arranged, in use, to align with an aperture in the pack;
- a door arranged to selectively close the opening;
- a mechanism for supporting the pack of wet wipes, the mechanism being urged towards the opening;
- a sensor arranged to detect the presence of a hand in the vicinity of the door; and
- a motor arranged to receive a signal from the sensor indicating movement in the vicinity of the door and to open the door upon receipt of the signal.

2. The container according to claim 1, wherein the mechanism is spring-loaded so as to be biased towards the opening.

3. The container according to claim 1, wherein the door is a sliding door.

4. The container according to claim 3, wherein in the open position, the door is received at least partially within the housing.

5. The container according to claim 1 further comprising a seal to seal the door with respect to the housing when the door is closed.

6. The container according to claim 1, wherein the sensor is a capacitive sensor.

7. The container according to claim 1, wherein the sensor is an infra-red sensor.

8. The container according to claim 1, wherein the motor is arranged to close the door a pre-set time after opening.

9. The container according to claim 1, wherein the motor is arranged to close the door once it ceases to detect the presence of a hand.

10. A container for a pack of wet wipes, the pack having a stack of wet wipes and an aperture in the top surface through which the wet wipes are accessible for dispensing, the container comprising:
- a housing to receive a pack of wet wipes;
- an opening in a top surface of the housing arranged, in use, to align with an aperture in the pack;
- a door arranged to selectively close the opening;
- a sensor arranged to detect the presence of a user in proximity of the door; and
- a motor arranged to receive a signal from the sensor indicating the presence of a user in proximity of the door and to open the door upon receipt of the signal.

11. The container according to claim 10 further comprising a spring-loaded mechanism for supporting the pack of wet wipes, the mechanism being biased towards the opening.

12. The container according to claim 10, wherein the door is a sliding door.

13. The container according to claim 12, wherein in the open position, the door is received at least partially within the housing.

14. The container according to claim 10 further comprising a seal to seal the door with respect to the housing when the door is closed.

15. The container according to claim 10, wherein the sensor is an infra-red sensor.

16. The container according to claim 10, wherein the motor is arranged to close the door a pre-set time after opening.

17. The container according to claim 10, wherein the motor is arranged to close the door once it ceases to detect the presence of a user in proximity of the door.

18. A container for a pack of wet wipes, the pack having a stack of wet wipes and an aperture in the top surface through which the wet wipes are accessible for dispensing, the container comprising:

a housing to receive a pack of wet wipes;

an opening in a top surface of the housing arranged, in use, to align with an aperture in the pack;

a sliding door arranged to selectively close the opening;

a spring-loaded mechanism for supporting the pack of wet wipes, the mechanism being biased towards the opening;

a seal to seal the door with respect to the housing when the door is closed;

a sensor arranged to detect the presence of a user in proximity of the door; and a motor arranged to receive a signal from the sensor indicating the presence of a user in proximity of the door and to open the door upon receipt of the signal;

wherein in the open position, the door is received at least partially within the housing.

* * * * *